US005496495A

United States Patent [19]

Beck et al.

[11] Patent Number: 5,496,495

[45] Date of Patent: Mar. 5, 1996

[54] DETERGENT FORMULATIONS FREE OF PHOSPHATES, ZEOLITES AND CRYSTALLINE LAYERED SILICATES

[75] Inventors: Rudolf Beck, Marl; Frank Krause, Kleve; Udo Schoenkaes, Haltern, all of Germany

[73] Assignee: Chemische Fabrik Stockhausen GmbH, Krefeld, Germany

[21] Appl. No.: 285,279

[22] Filed: Aug. 3, 1994

[30] Foreign Application Priority Data

Aug. 4, 1993 [DE] Germany ..... 43 26 129.9

[51] Int. Cl.[6] ..... C11D 3/37

[52] U.S. Cl. ..... 252/174.23; 252/174.24; 252/156; 252/DIG. 2; 252/DIG. 6; 8/137.5

[58] Field of Search ..... 252/174.24, 174.23, 252/156, DIG. 2, DIG. 6; 8/137, 137.5, 139; 526/271

[56] References Cited

U.S. PATENT DOCUMENTS

| | | | |
|---|---|---|---|
| 4,473,485 | 9/1984 | Greene | 252/174.12 |
| 4,647,396 | 3/1987 | Denzinger et al. | 252/174.24 |
| 4,686,062 | 8/1987 | Kermode et al. | 252/99 |
| 4,702,858 | 10/1987 | Denzinger et al. | 252/174.24 |
| 4,897,215 | 1/1990 | Trieselt et al. | 252/174.24 |
| 5,112,905 | 5/1992 | Colombo et al. | 525/60 |

FOREIGN PATENT DOCUMENTS

| | | | |
|---|---|---|---|
| 0451508 | 10/1991 | European Pat. Off. . | |
| 0497611 | 8/1992 | European Pat. Off. . | |
| 4316741 | 11/1994 | Germany . | |
| 2109398 | 6/1983 | United Kingdom . | |
| WO9415978 | 7/1994 | WIPO . | |
| 9418296 | 8/1994 | WIPO | 252/174.24 |

*Primary Examiner*—Paul Lieberman
*Assistant Examiner*—Lorna M. Douyon
*Attorney, Agent, or Firm*—Oblon, Spivak, McClelland, Maier & Neustadt

[57] ABSTRACT

The present invention relates to detergent formulations which contain (a) 3 to 70% by weight of one or more surfactants;

(b) 1 to 60% by weight of a readily biodegradable copolymer which comprises monomer units obtained from (A) monoethylenically unsaturated dicarboxylic acids, anhydrides, salts thereof or mixtures thereof, (B) monoethylenically unsaturated monocarboxylic acids, salts thereof or mixtures thereof, (C) monounsaturated monomers which aqueous polymerization, after hydrolysis or saponification, give monomer units which have one or more free hydroxyl groups on a carbon chain of the copolymer, and (D) 0 to 15% by weight of one or more further monomers capable of free radical copolymerization;

(c) 0 to 60% by weight of washing alkalis; and (d) 0 to 70% by weight of standardizing agents, and their use in inhibiting incrustation of textiles and in removing alkaline earth metals from textiles during laundering.

13 Claims, No Drawings

DETERGENT FORMULATIONS FREE OF PHOSPHATES, ZEOLITES AND CRYSTALLINE LAYERED SILICATES

BACKGROUND OF THE INVENTION

1. Field of the Invention

The present invention relates to detergent formulations which are free of phosphates, zeolites and crystalline layered silicates and which contain biodegradable polymers as builders.

2. Discussion of the Background

In detergents, materials known as builders are required as ingredients, in addition to surfactants. The function of the detergent builders is predominantly to eliminate from the wash process the calcium and magnesium ions originating from the wash water or from the dirt by complexing, dispersing and sequestering and to support the washing action of the surfactants. The builders prevent deposition on the fabrics, reduce incrustation of the textiles and improve primary detergency.

In traditional detergent formulations, polyphosphates, which also have outstanding performance characteristics, were used as builders. However, the use of phosphates in detergents is ecologically undesirable, since the pollution of effluents with phosphates leads to eutrophication of surface waters and to the problems associated therewith.

Today, combinations of water-softening silicates, such as zeolites or crystalline layered silicates, and polymers containing carboxylate groups are often used as builders in powder detergents. In this system, the zeolites or the layered silicates act as ion exchangers and soften the washwater by binding calcium and magnesium ions. The efficiency of the washing powders is substantially increased by the addition of polycarboxylates as cobuilders. Such builder systems are described, for example, in the textbook by J. Falbe, Surfactants in Consumer Products, 1987, 262–265 and 286–290, in European Patent 0,025,551 and in Seifen-Öle-Fette-Wachse, NO. 18, 714 (1990).

Although the zeolites or crystalline layered silicates contained in the above-mentioned agents are not a danger to the environment, they have the disadvantage of contributing to a substantial increase in the amount of sewage sludge. There have therefore already been attempts to eradicate the use of water-softening silicates in phosphate-free detergent powders.

German Offenlegungsschrift 3,930,791 describes phosphate and zeolite-free detergents which contain polycarboxylates, in particular copolymers of acrylic acid and maleic acid, as incrustation inhibitors. However, these polymer builder substances have a disadvantage due to their low biodegradability.

German Offenlegungsschrift 4,022,005 claims the combination of citrate and polycarboxylates as builders in zeolite-free fine detergents. The polymers used have molecular weights of 30,000–120,000 g/mol. Accordingly, they possess only low biodegradability and can only be mineralized in the wastewater treatment plant to a small extent.

There is a strong desire in the art to provide detergents which are both phosphate and zeolite-free and which combine the characteristic of excellent biodegradability, while maintain high levels of detergency and incrustation inhibition.

SUMMARY OF THE INVENTION

Accordingly, one object of the present invention is to provide detergent formulations which are free of zeolites and crystalline layered silicates as water-softening silicates and which contain biodegradable and ecologically well tolerated polymers as a phosphate substitute.

A further object of the present invention is to provide a method for removing alkaline earth metal ions from dirty and/or soiled textiles using these detergents.

A further object of the present invention is to provide a method for inhibiting incrustation during laundering of dirty and/or soiled textiles using these detergents.

These and other objects of the present invention have been achieved, by the discovery of detergent formulations which contain surfactants and biodegradable copolymers which comprise (A) monoethylenically unsaturated dicarboxylic acids, anhydrides and/or salts thereof, (B) monoethylenically unsaturated monocarboxylic acids and/or salts thereof, (C) monounsaturated monomers which, after polymerization and hydrolysis or saponification, give monomer units which have one or more hydroxyl groups on the carbon chain, and (D) 0 to 15% by weight of further monomers capable of free radical copolymerization, and optionally containing washing alkalis, standardizing agents and/or further functional auxiliaries and their use providing improved laundering of textiles.

DETAILED DESCRIPTION OF THE PREFERRED EMBODIMENTS

The present invention relates to detergent formulations which are free of zeolites and crystalline layered silicates and which comprise:

(a) 3 to 70% by weight of one or more surfactants;

(b) 1 to 60% by weight of a readily biodegradable copolymer which comprises monomer units obtained from (A) monoethylenically unsaturated dicarboxylic acids, anhydrides, salts thereof or mixtures thereof, (B) monoethylenically unsaturated monocarboxylic acids, salts thereof or mixtures thereof, (C) monounsaturated monomers which aqueous polymerization, after hydrolysis or saponification, give monomer units which have one or more free hydroxyl groups on a carbon chain of the copolymer, and (D) 0 to 15% by weight of one or more further monomers capable of free radical copolymerization;

(c) 0 to 60% by weight of washing alkalis; and (d) 0 to 70% by weight of standardizing agents.

The detergents according to the present invention may contain anionic, nonionic or cationic surfactants (a) or mixtures thereof. The mixtures preferably used are those comprising anionic and nonionic products, which exhibit synergistic detergent effects and are frequently combined with soaps. However, it is also possible to use exclusively anionic or nonionic surfactants. The amount of surfactants (a) is preferably 5 to 40% by weight, with contents of 7 to 25% by weight being more preferred.

Suitable anionic surfactants include sulphonates and sulphates. Examples of sulphonate-type surfactants include $C_{11}$–$C_{13}$-alkylbenzenesulphonates, $C^{13}$–$C^{17}$-alkanesulphonates and ester sulphonates having chain lengths of 12 to 20 C atoms. Examples of sulphate-type surfactants include the monoesters of sulphuric acid with fatty alcohols of synthetic and natural origin, such as coconut fatty alcohol, tallow fatty alcohol, oleyl alcohol or $C_{10}$–$C_{20}$-oxo alcohols. Fatty alcohol ether sulphates, such as lauryl ether sulphate, may also be used.

Other suitable anionic surfactants are soaps, including saturated fatty acid soaps, such as the alkali metal or alkanolamine soaps of lauric acid, myristic acid, palmitic acid and stearic acid. Soap mixtures derived from natural fatty acids, such as coconut, palm kernel or tallow fatty acids, are preferred.

Suitable nonionic surfactants include adducts of ethylene oxide and/or propylene oxide with alkylphenols, oxo alcohols or natural fatty alcohols, fatty acids, fatty amines and fatty acid amides. The adducts of 3 to 15 mol of ethylene oxide with coconut and tallow fatty alcohols, with oleyl alcohol or with synthetic alcohols having 8 to 18 C atoms are particularly preferred. Surfactants of the type comprising the $C_8$–$C_{18}$-alkylpolyglucosides, such as $C_{10}$– $C_{12}$- and $C_{12}$–$C_{16}$-alkylpolyglucosides, and amine oxides may also be used.

However, it is also possible to use cationic surfactants and amphoteric products, such as ampholytes and betaines.

The detergent formulations according to the present invention furthermore contain the copolymers (b). The amount of (b) is preferably 5 to 40% by weight, amounts of 5 to 20% by weight being most preferred.

Suitable monomers of group (A) include monoethylenically unsaturated $C_4$–$C_8$-dicarboxylic acids, their anhydrides or their alkali metal and/or ammonium salts and/or amine salts. Examples of suitable dicarboxylic acids are maleic acid, fumaric acid, itaconic acid and methylenemalonic acid. Maleic acid, maleic anhydride, itaconic acid, itaconic anhydride and the corresponding sodium, potassium and ammonium salts of maleic or itaconic acid are preferably used. The monomers of group (A) are preferably present in the monomer mixture in an amount of 10 to 70% by weight, more preferably 20 to 60% by weight and most preferably 25 to 55% by weight.

Suitable monomers of group (B) are monoethylenically unsaturated $C_3$–$C_{10}$-monocarboxylic acids and their alkali metal and/or ammonium salts and/or amine salts. These monomers include acrylic acid, methacrylic acid, dimethylacrylic acid, ethylacrylic acid, vinylacetic acid and allylacetic acid. From this group of monomers, acrylic acid, methacrylic acid, mixtures thereof and the sodium, potassium or ammonium salts or mixtures thereof are preferably used. The monomers of group (B) are preferably present in the monomer mixture in an amount of 20 to 85% by weight, more preferably 25 to 60% by weight and most preferably 30 to 60% by weight.

By "salt thereof" is meant a salt of the monomer unit (A) or (B), above, wherein the counter ion is, for instance, ammonium, amine, alkali, alkaline earth metal, and the like. The ammonium salt may be $NH_4^+$, or a mono-, di-, tri-, and tetra-alkylammonium salt, wherein the alkyl group is preferably a $C_1$–$C_6$, more preferably $C_1$–$C_4$, alkyl group, either branched or straight chain. The counter ion may also be, for instance, a mono-, di-, tri-, or tetraalkanolammonium salt, preferably $C_2$–$C_4$.

The monomers of group (C) are monomers which, after the copolymerization is performed, give upon subsequent hydrolysis or saponification of the copolymer, one or more hydroxyl groups which are covalently bonded directly to the C—C polymer carbon chain. Examples of suitable monomers (C) include the following: vinyl acetate, vinyl propionate, methylvinyl acetate, methyl vinyl ether, ethylene glycol monovinyl ether and vinylidene carbonate. The monomers of group (C) are preferably present in the monomer mixture in an amount of 1 to 50% by weight, more preferably 4 to 40% by weight and most preferably 8 to 30% by weight.

Suitable monomers of group D, which may be optionally used for modification of the copolymers, include monomers containing sulphonyl groups and sulphate groups, such as methallylsulphonic acid, vinylsulphonic acid, styrenesulphonic acid and acrylamidomethylpropanesulphonic acid, and monomers containing phosphonic acid groups, such as vinylphosphonic acid, allylphosphonic acid and acrylamidomethylpropanephosphonic acid and salts thereof, and hydroxyethyl (meth)acrylate sulphates, allyl alcohol sulphates and allyl alcohol phosphates. Diethylenically unsaturated nonconjugated compounds and polyalkylene glycol esters of (meth)acrylic acid and polyalkylene glycol ethers with (meth)allyl alcohol, which may be blocked, can also be used as monomers of group (D)—but only in a limited amount owing to the required solubility. The monomers of group (D) are optionally present in the monomer mixture in an amount of up to 15% by weight, preferably up to 10% by weight.

The copolymers can be prepared by free-radical polymerization, for instance, in aqueous medium. A polymerization of this type is described in the German patent application file No. P 43 00 772.4, incorporated by reference. As described therein, the production of the unsaponified copolymers takes place in aqueous solution at 40°–180° C. in the presence of polymerization initiators which form radicals under polymerization conditions, e.g., inorganic and organic peroxides, persulfates, azo compounds and so-called redox catalysts. The reducing component of redox catalysts can be formed, for example, of compounds such as sodium sulfite, sodium bisulfite, sodium formaldehyde sulfoxylate and hydrazine. Often, it is advantageous to use a combination of peroxide and/or persulfate, reduction agent(s) and heavy metal as the redox catalyst. The copolymerization can also be carried out by means of the effect of ultraviolet radiation, in the presence of photo-initiators. If regulation of the molecular weight is desired, polymerization regulators are used. Suitable regulators, for example, are mercapto compounds, alkyl compounds, and aldehydes. Initiators and regulators are known per se. See, for instance, G. Odian, *Principles of Polymerization,* 1st and 2nd Editions, and in *Polymer Handbook,* 3rd Edition, Edited by J. Brandrup, et. al., incorporated herein by reference.

Polymerization takes place in the usual polymerization vessels at temperatures of preferably 40°–180° C., under pressure if necessary, e.g., if the boiling temperature would otherwise be exceeded. A more preferred temperature range for polymerization is between 60°–120° C. The reaction is carried out preferably in an inert gas atmosphere, e.g., by blowing in nitrogen and, if desired, with the exclusion of oxygen. The monomer components are either added to the polymerization vessel in bulk or in aqueous solution, and polymerized by adding the initiator system. In a preferred embodiment, they are metered into the polymerization reactor over a period of 1–10 hours, more preferably 2–8 hours.

One embodiment consists of metering in the monomer components (B)–(D) into a reaction vessel containing monomer component (A). In this case, monomer components (B)–(D) can be added either as a mixture and/or separately.

A preferred embodiment consists of presenting maleic acid and part or all of the vinyl acetate together, and metering in the remaining monomers. This method of monomer addition has the advantage of significantly reducing the pressure which builds up in the closed vessel during the polymerization reaction due to the decarboxylation of maleic acid units in the polymer chain. Thus, the polymers produced according to this preferred embodiment contain more carboxyl groups than those in which the vinyl acetate was not originally present.

The initiator system is preferably metered in parallel to the monomers and its addition is preferably continued for a time after completion of monomer metering, in order to complete the monomer conversion. In order to obtain copolymers with a low residual content of maleic acid, and in order to suppress premature saponification of monomer units (C), the acid monomers which are used are neutralized or at least partially neutralized. This can be done by neutralization or partial neutralization of monomers (A) that are added to the polymerization vessel, and/or also by complete or partial neutralization of monomer (B) and/or (D) that are to be metered in.

After completion of the polymerization, if necessary, components with a low boiling point, such as residual monomers or their hydrolysis products, for example, are distilled off, preferably under a partial vacuum, and the monomer units (C) are saponified so that hydroxyl groups are present. The saponification preferably takes place in an acidic or basic environment, with pH values of less than 2 and more than 10 being preferred. Depending on the monomer type, the saponification preferably takes place in 0.5 to 5 hours at 80°–130° C. The highly volatile reaction products which are formed during saponification can also be separated by distillation, if necessary in a partial vacuum. The degree of saponification of the saponifiable monomer units is not particularly critical as long as the aforementioned criteria for monomer units (C) are met, but is preferably 1–100% , more preferably 30–100% and especially preferably 60–100%. After completion of the saponification, the pH of the aqueous polymer can be adjusted, if necessary, by use of the known agents, such as lyes and bases, mineral acids, carboxylic acids and polycarboxylic acids.

The polymerization can also be carried out as a suspension polymerization, with the aqueous monomer phase being dispersed in an organic phase, which can consist of cyclohexane, for example, with the help of suspension stabilizers. The copolymer I is polymerized out and saponified in the form of this suspension. Subsequently, the water can be distilled off from the suspension in azeotropic manner, and the solid polymer particles can be filtered off from the organic phase.

The copolymer comprising monomer units (A)–(C), with optional component (D), has a preferred molecular weight (weight average) of between 500–5,000,000 g/mol. More preferably, the molecular weight ranges from 500–70,000 g/mol. A still more preferred range is 1,000–50,000, and even more particularly preferred is 2,000–30,000 g/mol. The most preferred range is from about 11,000–30,000 g/mol.

The polymers obtained in aqueous solution can, if required, be converted into pulverulent products by conventional drying methods, such as spray-drying.

The copolymers of the present invention act as dispersants and complexing agents. Polyvalent metal ions, such as Ca, Mg and Fe ions, are bonded to the copolymer in water-soluble complexes. The copolymers disperse precipitated water hardness components and dirt particles.

By using the compositions of the present invention, it is possible, as a rule, to dispense with or greatly reduce the use of conventionally used complexing agents and dispersant agents, such as phosphates, phosphonates, poorly degradable polyacrylates, nitrilotriacetic acid and salts thereof, ethylenediaminetetraacetic acid and salts thereof, which have ecological disadvantages.

The copolymers can of course also be combined with water-softening silicates, such as, for example, zeolites and crystalline layered silicates. The efficiency of the copolymers as a cobuilder is thus increased. However, the above-mentioned disadvantages of the water-softening silicates must then be expected and accordingly, such combinations do not form an embodiment of the present invention.

The copolymers of the present formulations are particularly distinguished by their biodegradability. For the purposes of this invention, the copolymers are biodegradable if they have a degree of degradation of ≧60% in the modified OECD Sturm test (EC Guideline 84/449/EEC C 5 and OECD Guideline 301 B) (cf. for example Seifen-Öle-Fette-Wachse 117 (1991), 740 to 744).

Suitable washing alkalis (c) are water-soluble, alkaline salts, such as alkali metal carbonates, alkali metal bicarbonates and alkali metal hydroxides. The group comprising the washing alkalis furthermore includes the water-soluble alkali metal silicates, which also have corrosion-inhibiting properties, such as sodium metasilicates and sodium disilicates. The amount of the washing alkalis in the agents is preferably 5 to 50% by weight.

In particular, inorganic neutral salts, such as sodium sulphate or sodium chloride, can be used as standardizing agents (d). If such products are used, they are preferably metered in amounts of 5 to 60% by weight.

In addition to the above-mentioned products, the detergent formulations may contain further functional auxiliaries described below.

In particular, peroxo compounds, such as sodium perborate mono- and tetrahydrate and percarbonates, can be used for bleaching purposes. The bleaches are included, if desired, in amounts of 0 to 30% by weight, with amounts of 5 to 20% by weight being preferred.

At low washing temperatures, oxygen bleaching can be improved by activators, such as tetraacetylethylenediamine (TAED). The bleach activator TAED is usually used in amounts of 0 to 10% by weight, with amounts of 2 to 7% by weight being preferred.

The formulations may also contain further dispersants and complexing agents. Suitable products include citrates, phosphonates, only slightly biodegradable homo-and copolymers of acrylic acid, isoserinediacetic acid, polyaspartic acid, ethylenediaminetetraacetic acid and nitrilotriacetic acid and the alkali metal salts of the above-mentioned substances. Such substances are contained in the detergents in concentrations of 0 to 50% by weight, preferably in amounts of 0.5 to 20% by weight.

Greying inhibitors, such as carboxymethylcellulose and carboxymethyl starches, may also be used. These inhibitors increase the dirt-carrying capacity of the wash liquors and are used in amounts of 0 to 2% by weight.

Alternatively, the formulations may also contain enzymes, in particular proteases, amylases and lipases. These enzymes may be included in amounts of 0 to 5% by weight, if desired.

Furthermore, antifoams, flow assistants, optical brighteners, color transfer inhibitors and fragrances and dyes may be present in the detergent formulations according to the invention.

The detergents according to the invention may be in the form of pulverulent types or granules.

The pulverulent detergents can be prepared by mixing the solid ingredients and, if required, by spraying on the liquid components or by spray-drying a batch of the starting components in the form of an aqueous liquid to an aqueous paste. Granulated products can be prepared, for example, by extrusion of pasty premixes. Such drying and granulation procedures are well known to those of skill in the detergent art.

The formulations according to the invention can be used as textile detergents in the household sector and in commercial cleaning processes. The copolymers (b) contained in the formulations have outstanding binding power for alkaline earth metal ions and high dispersing power, so that it is possible to dispense with the use of water-softening silicates, such as zeolites or crystalline sodium sheet silicates. The detergents according to the invention have a good dirt-releasing and dirt-dispersing effect and lead to only slight incrustation during the washing of textiles with hard water.

The agents may be used in strongly foaming formulations, as are used in hand washing, or in foam-regulating surfactant systems which are used in machine washing.

In comparison with formulations in which the component (b) is replaced by a commercial compound, the formulations according to the invention are better or at least as good in their efficiency at cleaning and removal of alkaline earth metal ions. However, the present formulations also provide significantly improved biodegradability.

Having generally described this invention, a further understanding can be obtained by reference to certain specific examples which are provided herein for purposes of illustration only and are not intended to be limiting unless otherwise specified.

COPOLYMER PRODUCTION EXAMPLES

Example 1

In a 2 L polymerization vessel made of glass, provided with a heating bath, stirrer, reflux cooler and metering devices suitable for liquid and gaseous substances, 63.9 g maleic acid anhydride in 260 g demineralized water and 93.6 g 50% soda lye are dissolved at 85° C. and 3.5 mg ferrous (II) ammonium sulfate are added. Then two solutions are metered into the polymerization vessel over a period of 4 and 4.5 hours, respectively. Solution I (4 hours) consists of 81.4 g acrylic acid, 42.1 g vinyl acetate and 100 g demineralized water, and solution II (4.5 hours) consists of 18.7 g 35% hydrogen peroxide and 54 g water.

After Solution II has been completely metered in, the interior temperature has increased to 92° C. Stirring continues at this temperature for 1 hour more, and 11 g aqueous phase and 5 g vinyl acetate are drawn off using a water separator. The polymerization solution is cooled to 40° C. and adjusted to pH 10 with soda lye, and saponified under reflux for 60 minutes, then cooled and adjusted to pH 7.0 with hydrochloric acid. The polymer has a molecular weight of Mw=22,175. In the IR spectrum, no ester bands can be detected.

Example 2

In a starting batch for polymerization according to Example 1 above, the following substance amounts used: 69.15 g maleic acid anhydride, 101.61 g 50% soda lye, 270 g demineralized water, 3.5 mg ferrous (II) ammonium sulfate are placed in the polymerization vessel; Solution I: 70.16 g acrylic acid, 60.2 g vinyl acetate, 50 g water; Solution II: 18.7 g 35% hydrogen peroxide, 100 g demineralized water.

After Solution II has been completely metered in, the product temperature is 86° C. Stirring continues at this temperature for 1 hour more, and 10 g aqueous phase and 3 g vinyl acetate are drawn off using a water separator. Further processing of the polymer takes place as described in Example 1. The molecular weight of the final product is Mw=14,077, and no ester bands can be detected in the IR spectrum.

Example 3

In a starting batch for polymerization according to Example 1, the following substance amounts are used: 114.8 g maleic acid anhydride, 313.2 g demineralized water, 168.5 g 50 % soda lye, 6.3 mg ferrous (II) ammonium sulfate are present in the reaction vessel; Solution I: 146.5 g acrylic acid, 45 g demineralized water, 65.1 g 50% soda lye, 35.4 g vinyl acetate; Solution II: 33.7 g 35% hydrogen peroxide, 2 g sodium peroxodisulfate, 300 g demineralized water.

After Solution II has been completely metered in, the product temperature is 92° C. Stirring continues at this temperature for 1 hour more, and 21.5 g aqueous phase are distilled off. Further processing of the polymer takes place as described in Example 1. The end product has a molecular weight of Mw=18,343.

Example 4

Here, the starting batch for polymerization of Example 1 is repeated with the following changes: Solution II: 119 g demineralized water, 13.17 g sodium peroxodisulfate; Solution III: 123 g demineralized water, 2.5 g sodium disulfite.

During metering of Solutions I-III, the product temperature is 65° C., and stirring is then continued at 90° C. for 1 hour more. In distillation, only an aqueous phase separates; there is no vinyl acetate present. Further processing of the product takes place as described in Example 1. The end product has a viscosity of 180 mPa.s.

Example 5

In a starting batch for polymerization according to Example 1, the following substances are used: 63.8 g maleic acid anhydride, 174 g demineralized water, 93.6 g 50% soda lye, 3.5 mg ferrous (II) ammonium sulfate are added to the vessel; Solution 1: 81.4 g acrylic acid, 42.1 g vinyl acetate, 100 g demineralized water; Solution II: 18.7 g 35% hydrogen peroxide, 144 g demineralized water.

After Solution II has been completely metered in, the interior temperature of the reactor is 90° C. Stirring continues at this temperature for 1 hour more, and 14 g water and 5 g vinyl acetate are distilled off. Further processing of the polymer takes place as described in Example 1. The end product has a dry substance content of 31% and a molecular weight of Mw=30,200.

Example 6

In a stirred stainless steel pressure reactor, 144.8 g maleic acid anhydride are dissolved in 308.0 g demineralized water and 212.6 g 50% soda lye, at 85° C., and mixed with 6.3 mg ferrous (II) ammonium sulfate. The reactor is flushed with nitrogen, sealed and heated to 90° C. Then two solutions (I and II) are metered into the reactor over a period of 4 and 4.5 hours, respectively, and stirring continues for 1 hour more at 90° C.

Solution I contains 124 g acrylic acid, 37 g demineralized water, 55.1 g 50% soda lye and 75 g vinyl acetate; Solution II contains 33.7 g 35% hydrogen peroxide, 2 g sodium peroxodisulfate and 205.8 g demineralized water.

After Solution II has been completely metered in, the interior pressure of the reactor is 3.8 bar. After cooling, 32.5 g water are distilled off from the reactor via a water separator. Vinyl acetate is no longer present. For saponification, the product is adjusted to pH 10.5 with soda lye and boiled under reflux for 1 hour, and subsequently neutralized with hydrochloric acid.

Example 7

Example 6 is repeated with the following changes: the iron salt is left out of the starting batch and no nitrogen flushing of the reactor takes place. Solution II is changed as follows: 25 g sodium persulfate in 205.8 g demineralized water. After Solution II has been completely metered in, a pressure of 3.5 bar has built up in the reactor. Further processing of the product takes place analogous to Example 6. 5 g vinyl acetate is taken off in the distillation stage.

Example 8

Here, polymerization is carried out corresponding to Example 6, in a pressure reactor, at 90° C., with no nitrogen flushing. The amounts used are as follows: 176.4 g maleic acid anhydride, 372.1 g demineralized water, 259.2 g 50% soda lye are present in the vessel; Solution I: 100.8 g acrylic acid, 48.6 g vinyl acetate, 45 g 50% soda lye, 30 g demineralized water; Solution II: 33.7 g 35% hydrogen peroxide, 171.0 g demineralized water.

After Solution II has been completely metered in, a pressure of 3.2 bar has built up. Further processing of the product takes place analogous to Example 6. The polymer has a molecular weight of Mw=11,100.

Example 9

Here, polymerization is carried out corresponding to Example 6, in a pressure reactor, at 90° C., with no nitrogen flushing. The amounts used are as follows: 113.4 g maleic acid anhydride, 248.8 g demineralized water, 166.7 g 50% soda lye, 6.3 mg ferrous (II) ammonium sulfate are present in the reaction vessel; Solution I: 34.9 g vinyl acetate, 45.0 g demineralized water, 145.8 g acrylic acid; Solution II: 33.6 g 35 1 hydrogen peroxide, 232 g demineralized water. No nitrogen gas addition takes place.

After Solution II has been completely metered in, a pressure of 2.6 bar has built up. Further processing of the product takes place as in Example 6. The polymer has a molecular weight of Mw=21,480.

Example 10

In a 2 L polymerization vessel made of glass, 313.2 g demineralized water, 114.8 g maleic acid anhydride and 168.5 g 50% soda lye are dissolved together while stirring, at 65° C. and then mixed with 35.4 g vinyl acetate Subsequently, 3 solutions are metered into the reactor at 65° C., within 2.5 hours. Solution 1: 146.5 g acrylic acid, 180 g demineralized water; Solution II: 22.3 g sodium peroxodisulfate, 141.4 g demineralized water; Solution III: 4.3 g sodium disulfite, 100.6 g demineralized water After they have been metered in, the temperature is maintained for 1 hour more, and for another hour at 90° C. Subsequent to this, saponification and neutralization of the product take place analogous to Example 1. The polymer has a viscosity of 670 mPa.s, and the molecular weight is Mw=132,000.

Example 11

Except for the amount of 17.7 g vinyl acetate which is used, this experiment is conducted like that of Example 10. During the polymerization and saponification, no carbon dioxide was released. The end product has a viscosity of 295 mPa.s.

Example 12

In a polymerization batch according to Example 1, the following substances are used: 63.8 g maleic acid anhydride, 260 g demineralized water, 52 g 50% soda lye, 3.5 mg ferrous (II) ammonium sulfate are present in the reaction vessel; Solution 1: 81.4 g acrylic acid, 22 g demineralized water, 45.1 g 50% soda lye, 42.1 g vinyl acetate; Solution II: 18.7 g 35% hydrogen peroxide, 128.4 g demineralized water.

After Solution 11 has been completely metered in, stirring continues at 85° C. for 1 hour more, and 10.1 g water and 2.7 g vinyl acetate are distilled off. Further processing of the polymer takes place as described in Example 1. The end product has a viscosity of 45 mPa.s, and the molecular weight is Mw=11,160.

Example 13

Here, Example 6 is repeated with the following changes: Solution I consists of 124 g acrylic acid, 30 g demineralized water, 55.1 g 50% soda lye and 117.97 vinyl acetate. No nitrogen flushing takes place.

After Solution II has been completely metered in, the interior pressure of the reactor has increased to 4.7 bar. The molecular weight of the polymer is Mw=17,275.

Example 14

Here, polymerization is carried out according to Example 6, in a pressure reactor, at 90° C., and no nitrogen flushing takes place. The amounts used are as follows: 220 g demineralized water, 127.9 g 50% soda lye, 87.1 g maleic acid anhydride are present in the reaction vessel; Solution I: 166.4 g acrylic acid, 80 g demineralized water, 73.9 g 50% soda lye, 30.6 g vinyl acetate; Solution II: 210 g demineralized water, 33.7 g 35 % hydrogen peroxide, 2 g sodium peroxodisulfate.

After solution II has been completely metered in, a pressure of 1.7 bar has built up. Further processing of the product takes place analogous to Example 6. The polymer has a viscosity of 320 mPa.s.

DETERGENT COMPOSITION EXAMPLES

The biodegradability of the copolymers was determined by the modified OECD Sturm test according to EC Guideline 84/449/EEC C 5 and OECD Guideline 301 B.

Example 1

Copolymer

A copolymer having an average molecular weight of about 15,000 g/mol was obtained by free radical polymerization of the sodium salt of 35% by weight of maleic anhydride, 45% by weight of acrylic acid and 20% by weight of vinyl acetate in aqueous solution, followed by saponification.

The thus obtained aqueous copolymer solution was converted into a pulverulent product by spray-drying.

Example 2

Biodegradability

A degree of degradation of more than 60% was found for the substance stated in Example 1.

In contrast, commercial polycarboxylates, such as homopolyacrylates and copolymers of acrylic acid and maleic acid, gave lower biodegradabilities.

Example 3

Formulations

Detergents having the following composition were prepared using the copolymer of Example 1 (data in % by weight):

| Detergent, pulverulent | 1 % | 2 % |
|---|---|---|
| n-Alkylbenzenesulphonate, Na salt | 5.0 | 4.5 |
| $C_{12}$–$C_{14}$-fatty alcohol ethoxylate 7-EO | 7.0 | 5.0 |
| Soap | 5.0 | 7.0 |
| Copolymer, pulverulent | 15.0 | 10.0 |
| Sodium carbonate | 30.0 | 25.0 |
| Sodium bicarbonate | — | 25.0 |
| Sodium perborate tetrahydrate | 15.0 | 15.0 |
| Sodium sulphate, light | 23.0 | 8.5 |

| Detergent, pulverulent | 3 % | 4 % | 5 % |
|---|---|---|---|
| $C_{12}$–$C_{18}$-fatty alcohol sulphate, Na salt | — | 2.0 | 15.0 |
| $C_{12}$–$C_{14}$-fatty alcohol ethoxylate 7-EO | — | 5.0 | 4.0 |
| $C_{13}$-oxo alcohol ethoxylate mixture (9 EO, 3 EO) | 9.0 | — | — |
| Soap | — | 5.0 | 2.0 |
| Copolymer, pulverulent | 15.0 | 20.0 | 8.0 |
| Sodium carbonate | 15.0 | 25.0 | 8.0 |
| Sodium bicarbonate | 26.0 | 25.0 | 8.0 |
| Sodium metasilicate pentahydrate | 10.0 | — | 6.0 |
| Carboxymethylcellulose | — | 1.5 | 1.5 |
| Sodium perborate tetrahydrate | 25.0 | — | — |
| Sodium sulphate, light | — | 16.5 | 55.5 |

| Detergent, pulverulent | 6 % | 7 % |
|---|---|---|
| $C_{12}$–$C_{14}$-fatty alcohol sulphate, Na salt | 4.0 | — |
| $C_{12}$–$C_{14}$-fatty alcohol ethoxylate 7-EO | 6.0 | 8.0 |
| Soap | 12.0 | 6.0 |
| Copolymer, pulverulent | 6.0 | 10.0 |
| Sodium citrate dihydrate | 30.0 | 10.0 |
| Sodium carbonate | 20.0 | 30.0 |
| Sodium disilicate | 20.0 | — |
| Enzymes | 2.0 | 1.0 |
| Sodium bicarbonate | — | 35.0 |

Comparative Formulation

A comparative formulation V1 was prepared using the commercial polycarboxylate Sokalan CP 5 (BASF, acrylic acid/maleic acid copolymer, Na salt, average molecular weight 70,000 g/mol):

| Comparative formulation | VI % |
|---|---|
| n-Alkylbenzenesulphonate, Na salt | 5.0 |
| $C_{12}$–$C_{14}$-fatty alcohol ethoxylate 7-EO | 7.0 |
| Soap | 5.0 |
| Polycarboxylate, pulverulent | 15.0 |

-continued

| Comparative formulation | VI % |
|---|---|
| Sodium carbonate | 30.0 |
| Sodium perborate tetrahydrate | 15.0 |
| Sodium sulphate, light | 23.0 |

Example 4

Testing of Performance Characteristics

Incrustation of fabric 6.0 g/l of the detergent formulations 1 to 3 according to the present invention and of comparative formulation V1 were used for washing in a commercial household washing machine under the following conditions:

| | |
|---|---|
| Test fabric: | Cotton |
| Wash cycles: | 12 washes |
| Wash temperature: | 90° C. |
| Water hardness: | 13° dH |

The deposits on the fabric (as measured by the ash content) were reduced as a result of the addition of the polymers of the present invention. In Table 1, the ash content is shown as a measure of the deposits.

TABLE 1

| Formulation | 1 | 2 | 3 | V1 |
|---|---|---|---|---|
| Ash content (%) | 0.47 | 0.46 | 0.43 | 0.51 |

When detergent formulations 1 to 3 according to the invention were used, lower fabric incrustations were obtained than in the case of the comparative formulation V1, which corresponds to the prior art. A further advantage of the formulations according to the invention is the biodegradability.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A detergent formulation which is free of phosphates, zeolites and crystalline layered silicates, comprising (a) 3 to 70% by weight of one or more surfactants;

(b) 1 to 60% by weight of a readily biodegradable copolymer having a carbon chain and one or more hydroxyl groups covalently bonded directly thereon, and which consists of monomer units obtained from (A) 10 to 70% by weight of monoethylenically unsaturated dicarboxylic acids, anhydrides, salts thereof or mixtures thereof, (B) 20 to 85% by weight of monoethylenically unsaturated monocarboxylic acids, salts thereof or mixtures thereof, (C) 1 to 50% by weight of monounsaturated monomers which upon polymerization, after hydrolysis or saponification, give monomer units which have one or more free hydroxyl groups covalently bonded directly on a carbon chain of the copolymer, and (D) 0 to 15% by weight of one or more further monomers capable of free radical copolymerization, said monomers containing groups selected from sulphonyl, sulphate, phosphonic and phosphate groups;

(c) 0 to 60% by weight of washing alkalis; and (d) 0 to 70% by weight of inorganic neutral salts.

2. The detergent formulation according to claim 1, wherein component (a) is present in an amount of 5 to 40% by weight.

3. The detergent formulation according to claim 1, wherein component (a) is present in an amount of 7 to 25% by weight.

4. The detergent formulation according to claim 1, wherein component (b) is present in an amount of 5 to 40% by weight.

5. The detergent formulation according to claim 1, wherein component (b) is present in an amount of 5 to 20% by weight.

6. The detergent formulation according to claim 1, wherein component (c) is present in an amount of 5 to 50% by weight.

7. The detergent formulation according to claim 1, wherein component (d) is present in an amount of 5 to 60% by weight.

8. A method for inhibiting incrustation of a textile comprising:

contacting the textile with an effective amount of an aqueous solution of a detergent formulation which is free of phosphates, zeolites and crystalline layered silicates, comprising (a) 3 to 70% by weight of one or more surfactants;

(b) 1 to 60% by weight of a readily biodegradable copolymer having a carbon chain and one or more hydroxyl groups covalently bonded directly thereon, and which consists of monomer units obtained from (A) 10 to 70% by weight of monoethylenically unsaturated dicarboxylic acids, anhydrides, salts thereof or mixtures thereof, (B) 20 to 85% by weight of monoethylenically unsaturated monocarboxylic acids, salts thereof or mixtures thereof, (C) 1 to 50% by weight of monounsaturated monomers which upon polymerization, after hydrolysis or saponification, give monomer units which have one or more free hydroxyl groups on a carbon chain of the copolymer, and (D) 0 to 15% by weight of one or more further monomers capable of free radical copolymerization, said monomers containing groups selected from sulphonyl, sulphate, phosphonic and phosphate groups;

(c) 0 to 60% by weight of washing alkalis; and (d) 0 to 70% by weight of inorganic neutral salts;

and rinsing the textile to remove said detergent formulation.

9. A method for removing alkaline earth metal ions from a textile having alkaline earth metal ions thereon, comprising:

contacting the textile with an effective amount of an aqueous solution of a detergent formulation which is free of phosphates, zeolites and crystalline layered silicates, comprising (a) 3 to 70% by weight of one or more surfactants;

(b) 1 to 60% by weight of a readily biodegradable copolymer having a carbon chain and one or more hydroxyl groups covalently bonded directly thereon, and which consists of monomer units obtained from (A) 10 to 70% by weight of monoethylenically unsaturated dicarboxylic acids, anhydrides, salts thereof or mixtures thereof, (B) 20 to 85% by weight of monoethylenically unsaturated monocarboxylic acids, salts thereof or mixtures thereof, (C) 1 to 50% by weight of monounsaturated monomers which upon polymerization, after hydrolysis or saponification, give monomer units which have one or more free hydroxyl groups on a carbon chain of the copolymer, and (D) 0 to 15% by weight of one or more further monomers capable of free radical copolymerization, said monomers containing groups selected from sulphonyl, sulphate, phosphonic and phosphate groups;

(c) 0 to 60% by weight of washing alkalis; and (d) 0 to 70% by weight of inorganic neutral salts;

and rinsing the textile to remove both the detergent formulation and the alkaline earth metal ions.

10. The detergent formulation of claim 1, wherein component (a) is present in an amount of 5 to 40% by weight, component (b) is present in an amount of 5 to 40% by weight, component (c) is present in an amount of 5 to 50% by weight and component (d) is present in an amount of 5 to 60% by weight.

11. The detergent formulation of claim 1, wherein component (a) is present in an amount of 5 to 40% by weight, component (b) is present in an amount of 5 to 40% by weight.

12. The detergent formulation of claim 1, wherein component (a) is present in an amount of 7 to 25% by weight, component (b) is present in an amount of 5 to 20% by weight.

13. The detergent formulation of claim 1, wherein component (b) is a readily biodegradable copolymer which comprises monomer units obtained from 10 to 70% of monomers (A), 20 to 85% of monomers (B), and 1 to 50% of monomers (C).

* * * * *